United States Patent [19]

Valentine

[11] 4,057,001

[45] Nov. 8, 1977

[54] ENDLESS CARRIER SLEEVE FOR DISCRETE FRAGMENTS

[75] Inventor: Jean A. Valentine, Winter Park, Fla.

[73] Assignee: Martin Marietta Corporation, Orlando, Fla.

[21] Appl. No.: 871,714

[22] Filed: Oct. 31, 1969

Related U.S. Application Data

[63] Continuation of Ser. No. 718,983, April 1, 1968.

[51] Int. Cl.[2] ..... F42B 33/00

[52] U.S. Cl. ..... 86/1 R; 102/67; 156/149; 156/173

[58] Field of Search ..... 156/173, 189, 190, 149, 156/552; 102/64, 65, 67; 87/6; 86/1

[56] References Cited

U.S. PATENT DOCUMENTS

| | | | |
|---|---|---|---|
| 2,109,479 | 3/1938 | Gibbons | 102/64 |
| 2,564,751 | 8/1951 | Cook | 102/67 X |
| 2,933,799 | 4/1960 | Semon | 102/67 |
| 3,033,729 | 5/1962 | Shobert | 156/149 |
| 3,272,672 | 9/1966 | Lampman et al. | 156/189 |
| 3,298,308 | 1/1967 | Thorner, Jr. | 102/67 |
| 3,400,628 | 9/1968 | Herzog | 87/6 |

*Primary Examiner*—Harold Tudor
*Attorney, Agent, or Firm*—Julian C. Renfro; Gay Chin

[57] ABSTRACT

This invention relates to the design and manufacture of a fragment shell usable in a warhead, with the novelty including the use of discrete fragments contained in a sleeve or tubing of considerable length, by virtue of which containment the fragments can be arrayed in operable form easily and rapidly.

8 Claims, 6 Drawing Figures

INVENTOR
JEAN A. VALENTINE

BY Julian C. Renfro
ATTORNEY

INVENTOR
JEAN A. VALENTINE

BY Julian C. Renfro
ATTORNEY

INVENTOR
JEAN A. VALENTINE

BY Julian C. Renfro
ATTORNEY

ENDLESS CARRIER SLEEVE FOR DISCRETE FRAGMENTS

This is a continuation of application Ser. No. 718,983 filed Apr. 1, 1968.

This invention relates to the production of controlled fragmentation warheads for projectiles, missiles, and the like, and more particularly to a highly effective design for disposing metallic fragments in a matrix strong enough to provide for structural integrity, but not so rigid as to degrade fragmentation patterns, as well as to the method of manufacturing such fragmentation devices.

In the past, a number of attempts have been made to manufacture fragmentation type warheads in a rapid and effective manner, with the configuration being such that hoped-for fragmentation patterns will be achieved without excessive energy being required to bring about separation of the fragments.

One prior art attempt involved the use of an elongated metallic bar wound in a helical fashion about a mandrel or the like, in association with which a wedge shaped punch was applied at closely spaced intervals during the winding process so as to create a fragmentation arrangement having definite fracture planes. However, a number of experiments have shown that this procedure is not only costly, but also a large amount of the energy of the explosion is required to separate the fragments, and the fragments usually separate into segments that are larger than desirable. This is to say, comparatively large fragments representing a number of notched segments often remain together subsequent to the detonation of the warhead, thus considerably impairing the desired fragment pattern and diminishing fragment velocity.

A different type of attempt to solve the problem of achieving a warhead having a satisfactory fragmentation pattern has involved the use of an inner core or the like of fiberglass to which are secured a number of fragments arrayed in a uniform assembly and held in place by tape. However, this arrangement has the disadvantage of requiring a considerable amount of layup time, particularly when it is realized that the fragments frequently fell away from the tape and had to be painstakingly replaced in the proper position by hand.

In accordance with the present invention, I utilize an arrangement involving a continuous tube or sleeve such as of braided fiberglass, in which tube or sleeve a large number of regularly configured fragments are disposed. Because the fragment-filled tube remains basically flexible, by this arrangement I am enabled to work freely and easily with the fragments and to dispose them in whatever intricate configuration or layup that may be desired. As will be apparent, I am thus enabled to dispose a large number of fragments in a highly effective pattern for use in a warhead or the like, without having to worry about the fragments falling out of the proper position. Significantly, a warhead utilizing this type of fragment layup has very regular and highly effective fragment patterns inasmuch as only a comparatively small amount of energy is required to separate fragments into separate pieces that may fly individually toward the target.

As will be understood, the fragmentation portions of the warheads can be laid up either by hand or automatically, and may involve the use of a mandrel upon which the fragment tubes are wound, which mandrel may either be stationary or rotary. I may program the spacing of the fragments in the tube such that the tube is sufficiently flexible that it can be used in the manufacture of warheads as small 3 inches in diameter. Thereafter, the fragment array can be solidified into a fragmentation shell by the use of a proper resin, thereby to simplify subsequent handling.

It is therefore an object of this invention to provide a fragment tube usable in warhead construction, which fragment tube can be made rapidly and inexpensively.

It is another object of my invention to provide a method for manufacturing warheads with a minimum of labor costs by virtue of the use of a fragment tube in which such fragments are disposed, thus assuring against the fragments being displaced during manufacture.

It is a further object of this invention to provide a fragment shell usable in a warhead, which fragment shell possesses sufficient strength that it can be worked with easily and effectively in the manufacture of warheads, yet which will separate into as many pieces as there are fragments upon detonation of the warhead with which the shell is associated.

These and other objects, features and advantages will be more apparent from a study of the enclosed drawings in which.

Figure 1:
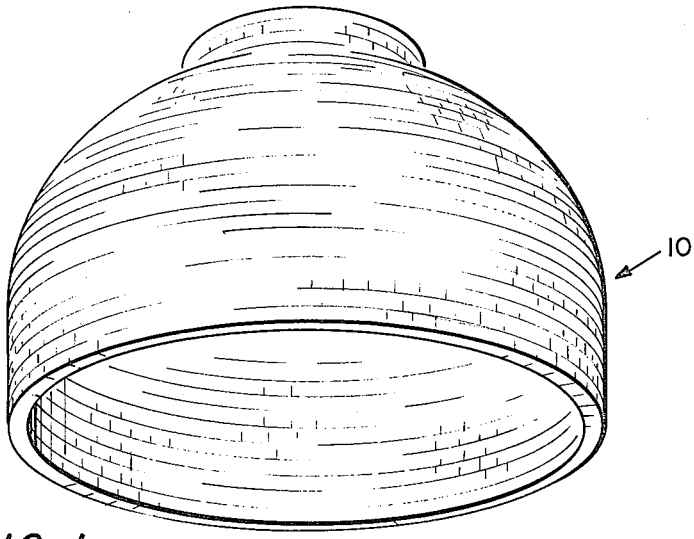
FIG. 1 is a lower perspective view of a fragment shell in accordance with this invention, with the outline of some of the many fragments therein being visible through the outer surface of the fragment shell.

Referring to FIG. 1, it will be noted that I have shown an exemplary view of a finished fragment shell 10 in accordance with this invention, made from a number of discrete metal fragments. The fragments are contained in a continuous fragment tube that has been wound so as to form a number of circularly stacked layers of fragments disposed together so as to form a shell having substantial rigidity. Although I am of course not to be limited to any specific shell configuration, it should be noted that the typical fragment shell is hollow so that upon the incorporation of same into the warhead of a bomb, missile or the like, explosive material can be disposed in the inner portion of the shell whereby upon subsequent detonation of same, the fragments can be dispersed in a highly lethal, uniform pattern.

Figure 2:
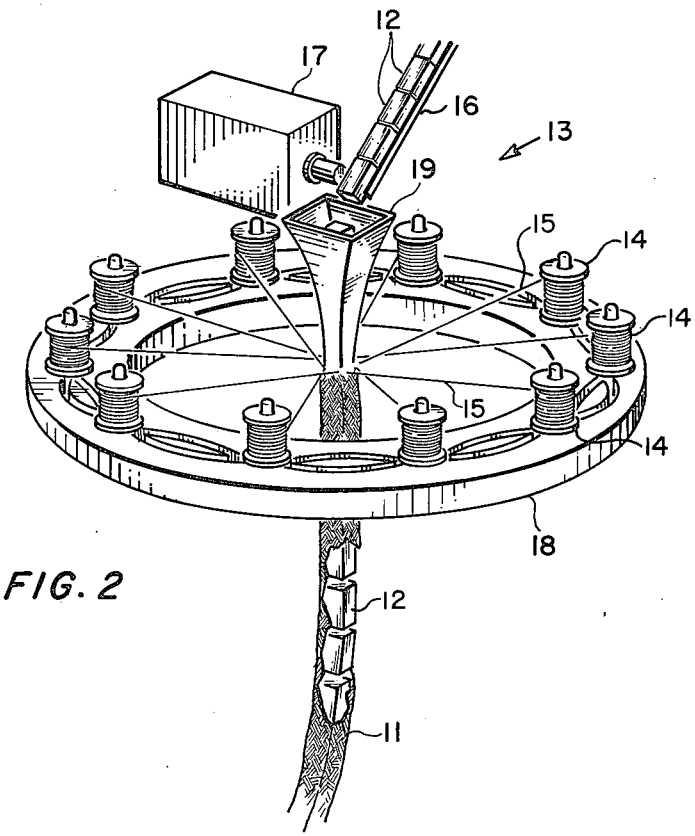
FIG. 2 illustrates a preferred procedure for the manufacture of the fragment tube of which the fragment shell is constructed.

Referring to FIG. 2, it will be seen from this somewhat schematic view that I can manufacture the fragment tubes ("fragtube") 11 by means of braiding a suitable material around the fragments 12 as they are carried to the proper location by a fragment insertion means 13. The fragment inserter, comprising principally a chute 16 and a fragment release means 17, may be disposed in the center of an array of spools 14 of material such as for example of fiberglass, which spools are mounted for movement on a circular track 18. Strands of filaments of thread 15 from these spools are brought to the center of the array and by virtue of movement of the spools in accordance with an acceptable braiding procedure, an encapsulating tube or sleeve 11 is formed around the fragments 12 as they are inserted by the mechanism 13. The braiding procedure used may generally be along the lines of that taught in the Hill et al U.S. Pat. No. 3,129,631, wherein, however, braiding is applied to a flexible, resilient filler element, rather than to discrete metallic fragments.

The fragments may drop by gravity into a hopper 19, and by action of the timer-operated release mechanism 17, the spacing of the fragments in the tube may be carefully controlled. In this particular instance, the release mechanism holds by magnetic means the lowermost fragment at any given moment, and then releases one fragment at a time into the hopper at the right time insofar as the braiding procedure is concerned. In this manner, the somewhat difficult procedure of inserting fragments into prewoven tubing or sleeving is obviated. This is not to say that my invention may not be practiced in latter manner, but it is to say that procedures such as vibrating the fragments are usually necessary for the proper insertion of same into existing tubing.

The completed fragment tube 11 is pulled by suitable means (not shown) away from the bottom of the hopper, such as by the action of a spool or drum upon which the fragment tube is wound. As will be appreciated, by winding the completed fragment tube upon drums, a convenient means is thus provided for the shipping of completed fragment tubes to the location at which fragment shells or warheads are to be formed. Of course, the completed fragtube could be led directly to a winding means for placement upon the mandrel in a proper manner if timewise such an operation was feasible.

Figure 3:
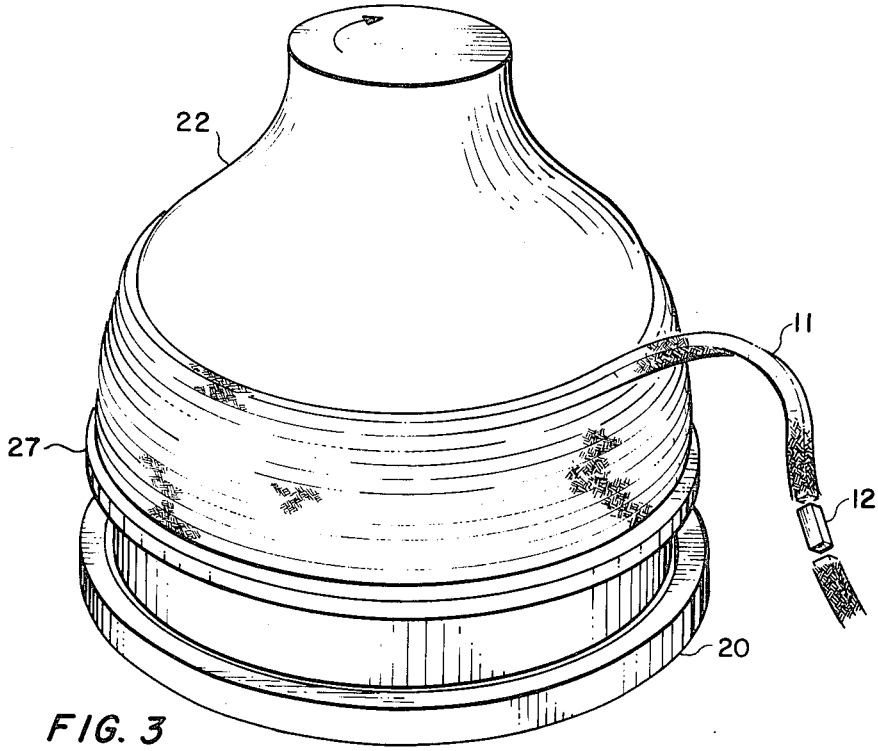
FIG. 3 illustrates an interim step in the procedure of constructing a fragment shell from fragment tube in accordance with this invention.

Turning to FIG. 3, it will be noted that the fragtube 12 is shown being wound upon a mandrel 22 of appropriate configuration. For purposes of illustration, I have shown the fragment tube 11 broken to reveal the use of fragments 12 therein, which fragments may be of steel and in the form of rectangular solids. A typical size is one-half long and one-quarter inch in cross section. Alternatively, the fragments could be cubic, spherical, cylindrical, etc.

Although fragment shells can be made in accordance with this invention by winding the fragment sleeve around and around the mandrel (or even around explosive material), I prefer to use a mandrel 22 that is rotatably mounted upon a base 20, with suitable means 28 for the driving of the mandrel in rotation at any of a range of selected speeds. The rotation of the mandrel may actually serve to cause the rotation of, as well as axial movement of, the dispensing spool. I am not to be limited to a single layer of fragtube on the mandrel, for obviously fragment shells made up of two or more layers of fragment thicknesses may be formed if desired.

If desired, I can program the number of fragments per foot of tubing so that when the tubing is wound around a circle of diminishing diameter, the fragment density can remain constant. Such of course can be accomplished by the use of a timer arrangement such as shown and described in conjunction with FIG. 2. Inasmuch as the braid is manufactured at a known rate and the timer may allow the fragments to drop at a given desired rate, a range of fragment densities can be obtained if desired. It should be noted that the braided construction of the sleeve minimizes the sliding of the fragments inside the sleeve.

Figure 4:
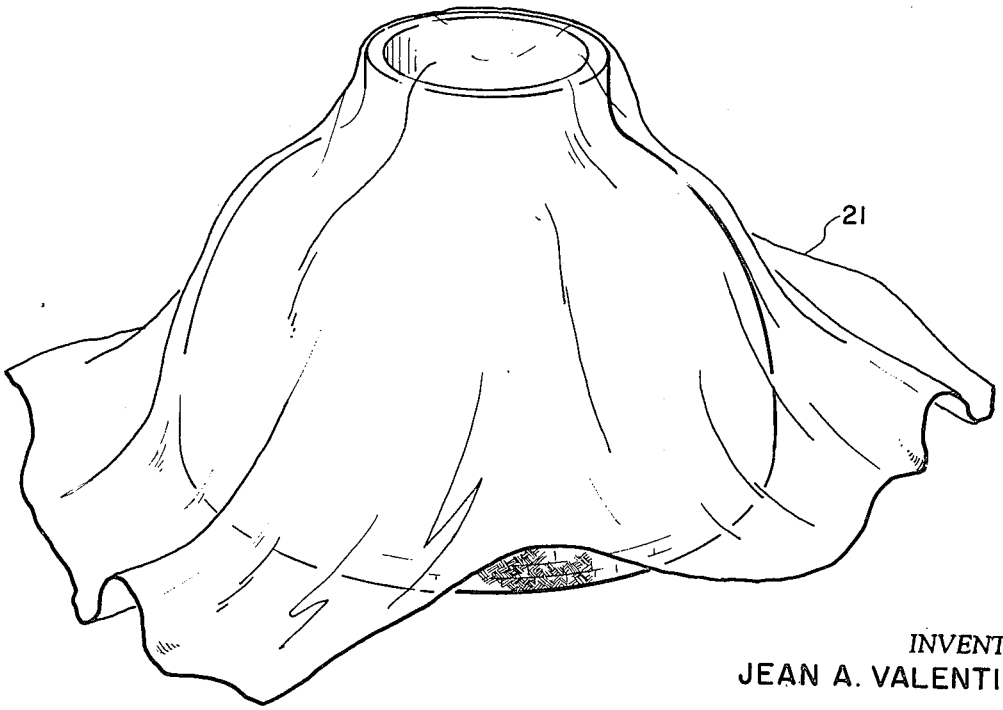
FIG. 4 represents the step of disposing an enveloping sheet of plastic over the fragment tube layup so that a vacuum may be employed during the impregnation of the fragments by a resin.
Figure 5:
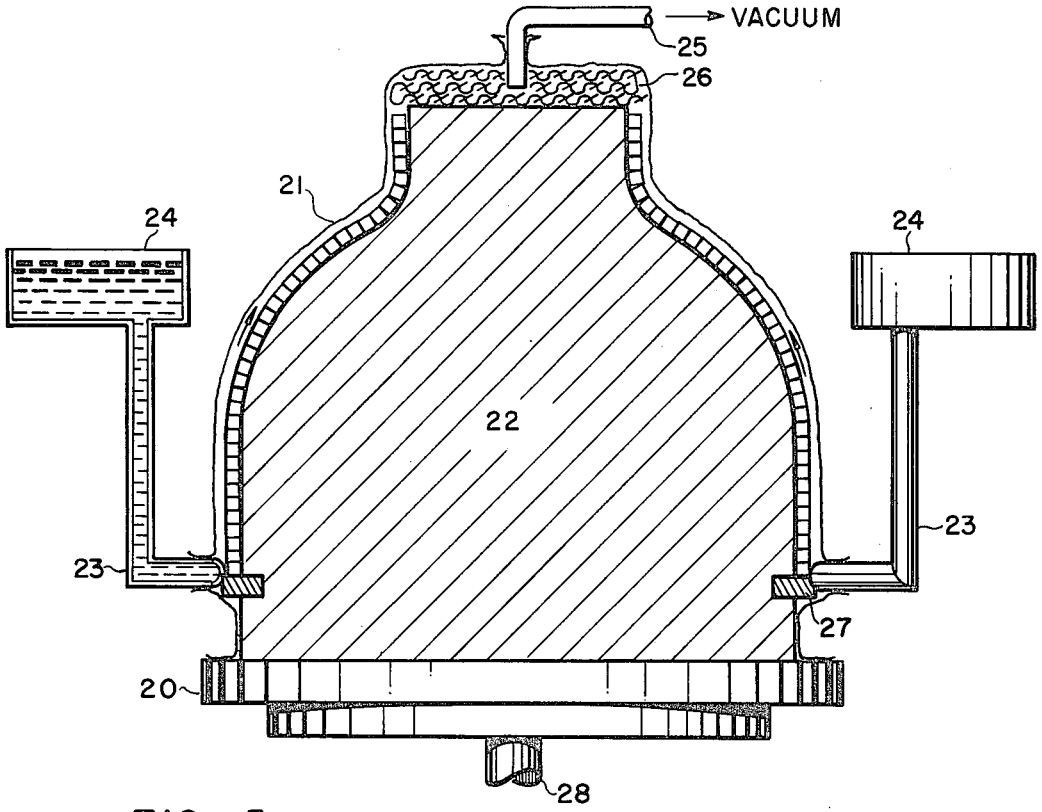
FIG. 5 represents a typical procedure whereby a suitable resin is caused to permeate the entire fragment tube layup.

It should be noted that a split ring 27 may be employed adjacent the base of mandrel 22, to prevent the fragtube from sliding too far down upon the mandrel as the winding procedure commences. When the winding of the fragment shell has been completed, a flexible, non-porous bag 21 is placed on top of the entire assembly, as shown in FIG. 4. This bag is preferably of polyethylene or some other suitable plastic material through which a vacuum will not be manifested. As shown in FIG. 5, I then apply at the base of the mandrel a suitable source of resin, which may be in the form of tubes 23 inserted under the bag adjacent the ring 27, these being connected to containers 24 of liquid resin. A vacuum connection 25 may be disposed at the top of the assembly, with a layer of burlap 26 or other cellular material preferably being disposed around the tube 25 to prevent clogging. Upon a vacuum being pulled on tube 25, the bag 21 is caused to cling very tightly to the sides of the fragment tube layup, thus closing any pores that would otherwise tend to admit atmospheric air.

Upon the vacuum being manifested for a sufficient length of time, the liquid resin from the sources 24 is caused to rise from the bottom of the arrangement to the top, with the resin being allowed to climb up through and around the layers of fragments, thus creating a void-free layup. The elimination of air pockets is highly desirable, and it is most important that the fragment shell attain sufficient strength that it can if desired be used as the primary structure of a warhead. If more strength is desired, one or several layers of fiberglass cloth (or any other suitable material) can be draped around the mandrel before the winding of the fragtube and also after this operation. Bagging and subsequent operations are carried on as for a single layer fragtube shell.

Figure 6:
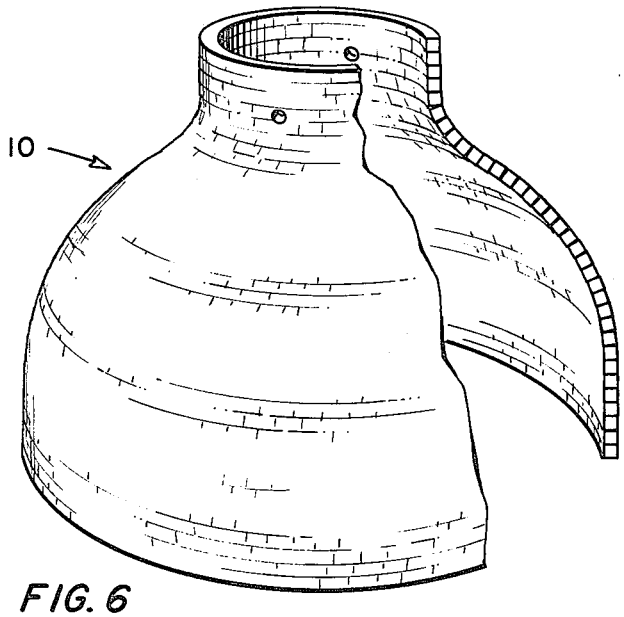
FIG. 6 represents a perspective view of the finished fragment shell subsequent to the curing of the resin, with portions of fragment shell being removed for reasons of clarity.

After the application of resin to the fragments has been completed, the entire assembly of mandrel and fragments is placed in an oven to allow the resin matrix to cure at the elevated temperature of the particular system. Curing time for the resin system is usually at least one hour, and after the appropriate time has elapsed, the entire assembly is allowed to cool in the oven in order to minimize shock stresses. Upon cooling, the assembly is removed from the oven, the bag material is stripped off of the fragment shell, and the shell is slipped free from the mandrel. The resulting fragment shell is shown in FIG. 6, which shell may then be filled with explosive in order to create the warhead portion of a bomb or missile.

As an alternative, the mandrel may be constructed from a thin metal shell, such as of aluminum, upon which the fragtube is wound. Impregnation and curing is accomplished as before, but the mandrel in this instance forms a permanent part of the fragment shell, and is not removed.

It should be realized that I have merely set forth exemplary facets of my invention, and I am not to be limited for example to the use of a braiding procedure for encapsulating the fragments. For example, woven tubes or even non-filamentary tubes such as of plastic could be substitued. Further, I am not to be restricted to the use of fiberglass in the practice of the facet of the invention set forth in connection with FIG. 2, for obviously cotton, nylon, or other filamentary material could be substituted.

I claim:

1. A method of constructing a fragment shell of the type used in an explosive device, said method comprising:

a. continuously forming an elongated flexible tube;

b. individually feeding a plurality of discrete fragments to said tube at a predetermined variable rate;

c. positioning said discrete fragments within said tube in a predetermined spaced relation to one another, whereby fragment density within a predetermined portion of said tube may be regulated by the rate of feed of said fragments to said tube;

d. wrapping the formed fragment containing tube about support means so as to arrange said tube into a shell configuration corresponding to the general shape of said support means; and e. securing the wound tube into a substantially rigid shell having a configuration defined by said support means.

2. A method of constructing a fragment shell as in claim 1, said method further comprising:

a. applying a hardening agent to the formed fragment containing tube when in a wrapped position; and b. removing the formed shell from the support means after hardening of said hardening agent.

3. A method of constructing a fragment shell as in claim 1, wherein said method further comprises:

a. wrapping the formed fragment containing tube about a substantially shell shaped mandrel;

b. applying hardening agent to the formed fragment containing tube when in wrapped position; and c. maintaining the shell shaped mandrel in permanently secured engagement with said wrapped fragment containing tube after application of said hardening agent.

4. A method of constructing a fragment shell as in claim 1, said method further comprising:

a. individually feeding said discrete fragments to said tube at a predetermined rate and simultaneously to the forming of said tube; and b. selectively regulating the rate of feed of said discrete fragments into said tube thereby selectively varying the fragment density of predetermined portions of said tube.

5. A method of constructing a fragment shell as in claim 1, wherein said method further comprises:

a. forming said flexible tube by securing a plurality of threads together in braided fashion; and b. feeding said discrete particles to said tube at a location immediately adjacent to an area of introduction of said discrete particles into said tube such that said threads are braided in contacting engagement with each of the spaced discrete fragments.

* * * * *